US007293509B2

(12) United States Patent
Hassell

(10) Patent No.: US 7,293,509 B2
(45) Date of Patent: Nov. 13, 2007

(54) PALLET FOR USE WITH LIFT JACK

(75) Inventor: Jon P. Hassell, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 27 days.

(21) Appl. No.: 11/195,985

(22) Filed: Aug. 2, 2005

(65) Prior Publication Data

US 2007/0028813 A1 Feb. 8, 2007

(51) Int. Cl.
*B65D 19/12* (2006.01)

(52) U.S. Cl. ..... 108/56.3; 108/51.11; 108/55.5; 108/54.1

(58) Field of Classification Search ..... 108/56.3, 108/902, 51.11, 57.25, 56.1, 57.26, 57.28, 108/55.5
See application file for complete search history.

(56) References Cited

U.S. PATENT DOCUMENTS

| | | | | |
|---|---|---|---|---|
| 1,608,039 | A * | 11/1926 | Romine | 108/51.11 |
| 4,186,841 | A | 2/1980 | Buckley et al. | |
| 4,478,156 | A | 10/1984 | Andersson | |
| 4,838,176 | A * | 6/1989 | Bowser et al. | 108/53.3 |
| 5,341,748 | A | 8/1994 | Liu | |
| 5,415,311 | A | 5/1995 | Coogan | |
| 5,456,189 | A | 10/1995 | Belle Isle | |
| 5,497,709 | A * | 3/1996 | Gonzalez et al. | 108/56.3 |
| 5,605,102 | A | 2/1997 | Simpson | |
| 5,606,921 | A * | 3/1997 | Elder et al. | 108/53.3 |
| 5,664,934 | A | 9/1997 | Schaede et al. | |
| 6,006,677 | A * | 12/1999 | Apps et al. | 108/57.25 |
| 6,021,721 | A * | 2/2000 | Rushton | 108/56.3 |
| 6,173,659 | B1 * | 1/2001 | Danks et al. | 108/54.1 |
| 6,199,487 | B1 * | 3/2001 | Coddington | 108/56.1 |
| 6,220,183 | B1 | 4/2001 | Schwitzky | |
| 6,234,087 | B1 | 5/2001 | Brown | |
| 6,257,152 | B1 | 7/2001 | Liu | |
| 6,446,563 | B1 * | 9/2002 | Ohanesian | 108/57.25 |
| 6,508,182 | B1 | 1/2003 | Smorgan et al. | |
| 6,745,703 | B2 | 6/2004 | Torrey et al. | |
| 7,231,740 | B2 | 6/2007 | Jirele | |
| D548,924 | S | 8/2007 | Frankenberg | |

FOREIGN PATENT DOCUMENTS

| | | |
|---|---|---|
| EP | 0 669 258 | 7/1992 |
| EP | 0 959 011 | 5/1999 |
| EP | 1 076 011 | 8/2000 |
| FR | 2 703 334 | 3/1993 |
| GB | 1 495 441 | 1/1975 |
| GB | 2 422 592 | 8/2006 |
| NL | 1003211 | 5/1996 |
| WO | WO 99/59884 | 11/1999 |

OTHER PUBLICATIONS

United Kingdom Search Report, Nov. 15, 2006.
United Kingdom Search Report, May 11, 2006.

* cited by examiner

*Primary Examiner*—José V. Chen

(57) ABSTRACT

A half pallet for use with a pallet lift jack includes a deck that is snap-fit to a plurality of supports. A lateral projection extends inwardly from each of the supports. A vertical projection protrudes upwardly from an inner end of the lateral projection and is spaced from the support such that a portion of a frame of the pallet lift jack can be received between the vertical projection and the support to prevent outward deflection of the supports.

13 Claims, 12 Drawing Sheets

PALLET FOR USE WITH LIFT JACK

CROSS-REFERENCE TO RELATED APPLICATION

This application is related to U.S. application Ser. No. 11/044,741 filed Jan. 26, 2005.

BACKGROUND OF THE INVENTION

This invention relates to a pallet. Pallets are often used to store and transport goods. Pallets maintain the goods at a distance above the floor such that they can readily be lifted and moved by a forklift. Plastic pallets are lighter and more durable than wooden pallets.

Some pallets are half the size of standard-sized pallets and are known as "half-pallets." The half-pallets include a deck and a plurality of spaced-apart feet extending down from the deck to form openings. These half-pallets are transported short distances, such as from a delivery truck into a store, by a person on a wheeled pallet lift jack. The pallet lift jack is first rolled into an opening between the feet of a loaded half-pallet. A pneumatic or mechanical lift mechanism on the pallet lift jack then lifts deck of the half-pallet upward until the feet of the half-pallet are off the ground and the loaded half-pallet can be freely rolled on the pallet lift jack.

One known half-pallet includes a plurality of lateral projections protruding inwardly from lower portions of the feet. These lateral projections contact an underside of the pallet lift jack when the half-pallet is lifted, thereby assisting in locking the half-pallet in position on the pallet lift jack. However, the force exerted against the lateral projections can cause the feet to deflect outwardly, causing the lateral projections to slip off the pallet lift jack.

The known half-pallet also includes recesses on the upper surface of the deck into which are received the feet of a similar pallet stacked thereon. Adjacent recesses (noncontiguous with the recesses that receive the feet) receive the lateral projections of the similar half pallet stacked thereon. The recesses help maintain the stability of a stack of the empty half pallets, but the arrangement of the recesses do not permit cross-stacking of empty half pallets. The feet do not fit into the recesses when cross-stacked.

SUMMARY OF THE INVENTION

A half pallet for use with a pallet lift jack includes a deck from which extends a pair of supports, each having at least one lateral projection that extends inwardly from the supports. A vertical projection protrudes upwardly from an inner end of the lateral projection and is spaced from the support such that a portion of a frame of the pallet lift jack can be received between the vertical projection and the support. This prevents the supports from being deflected outwardly when the half pallet is locked against the frame of the pallet lift jack, thereby improving the stability of the stacked half pallets on the pallet lift jack.

In two disclosed embodiments, the deck is snap-fit to the pair of supports. In a first embodiment, the two supports are molded separately from one another. In a second embodiment, the two supports are integrally molded and connected at lower ends by a plurality of runners. The snap-fit connections make assembly and disassembly simple and fast and permit the easy repair of damaged pallets. The pallet may be easier to manufacture in multiple snap-together pieces than as a single, integrally-molded structure, depending on the manufacturing process.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENTS

Figure 1:
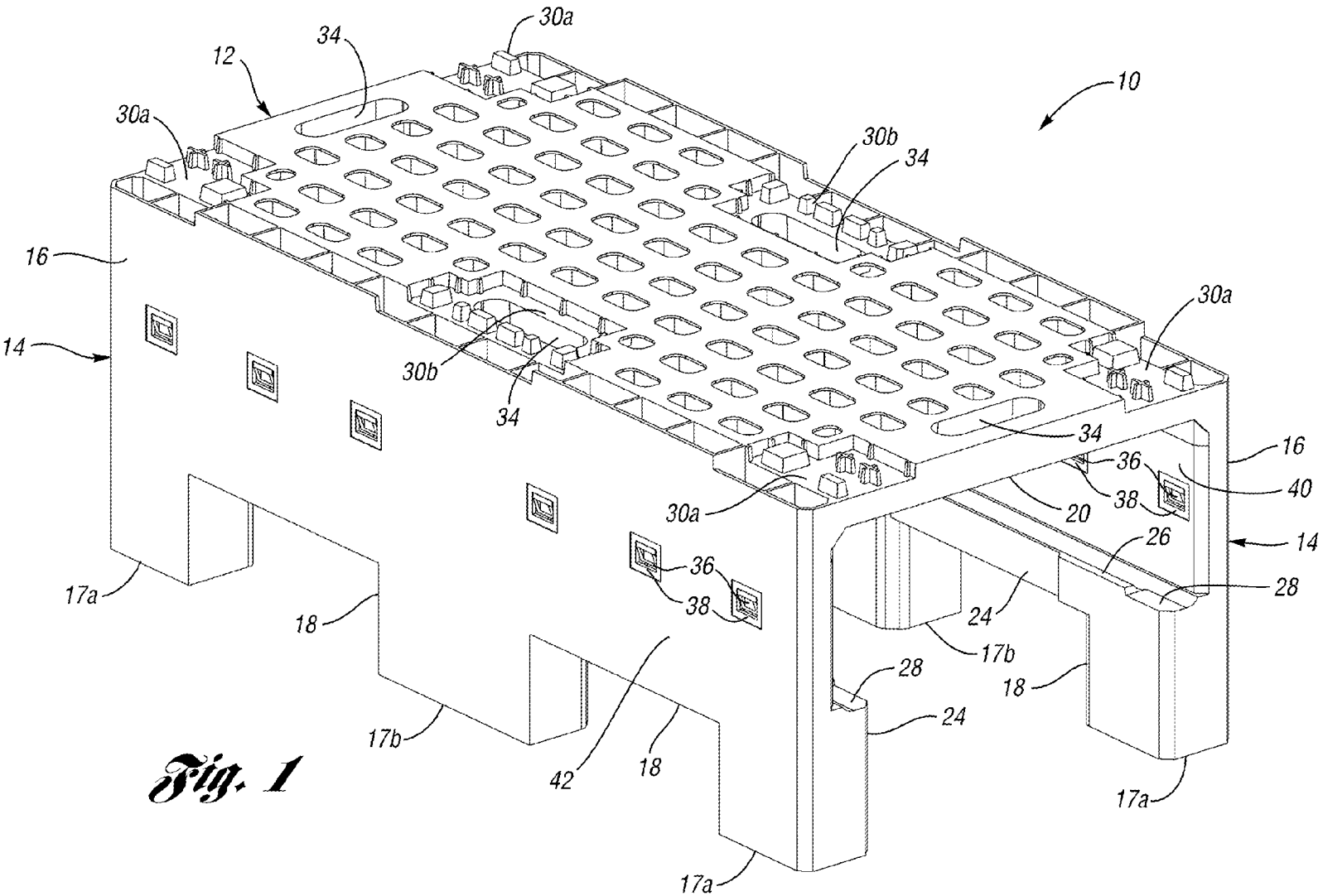
FIG. 1 is a perspective view of a pallet according to the present invention.

A pallet 10 of the half-pallet type is shown in FIG. 1. The pallet 10 includes a deck 12 supported by two supports 14. Each support 14 includes a side wall 16 and two corner feet 17*a* and a side foot 17*b* (collectively "feet 17"). Side walls 16 extend partially down from the deck 12 and connect the feet 17 to define fork-receiving openings 18. A pallet lift jack opening 20 is defined at each end of the pallet by the deck 12 and supports 14.

Each of the side walls 14 includes an elongated lateral projection 24 extending inwardly (i.e. toward the opposite support 14). The lateral projection 24 in the embodiment shown extends the entire length of the side wall 14, including the feet 17. Alternatively, the lateral projection 24 could just extend between the feet 17 or only from the feet 17. A vertical projection 26 protrudes upwardly from an inner end of the lateral projection 24. The vertical projection 26 may also extend the entire length of the side wall 14, but in the embodiment shown each vertical projection 26 stops just short of each end of the side wall 14 to form a flattened portion 28 at each end of the side wall 14. The existence and location of the flattened portion(s) 28 may depend upon the configuration of the pallet lift jack used with the pallet 10.

The deck 12 includes a plurality of interlocking features 30*a, b* on its upper surface. In the embodiment shown, the interlocking features 30*a, b* are a combination of projections and recesses, but they could alternatively be formed as just projections or just recesses. The interlocking features 30*a, b* include L-shaped corner interlocking features 30*a* and T-shaped side interlocking features 30*b*. As should be apparent from the Figures, the corner interlocking features 30*a* are shaped to receive in an interlocking manner the corner feet 17*a*, and the side interlocking features 30*b* are shaped to receive in an interlocking manner the side feet 17*b* of a similar pallet stacked thereon. As will be described in more detail below, the interlocking features 30*a, b* are also configured to receive the feet 17*a, b* of a similar pallet cross-stacked thereon. The deck 12 may include one or more handles 34 formed thereon, such as adjacent the ends of the pallet 10, as shown. Two of the handles 34 are formed in the side interlocking features 30*b*.

Figure 2:
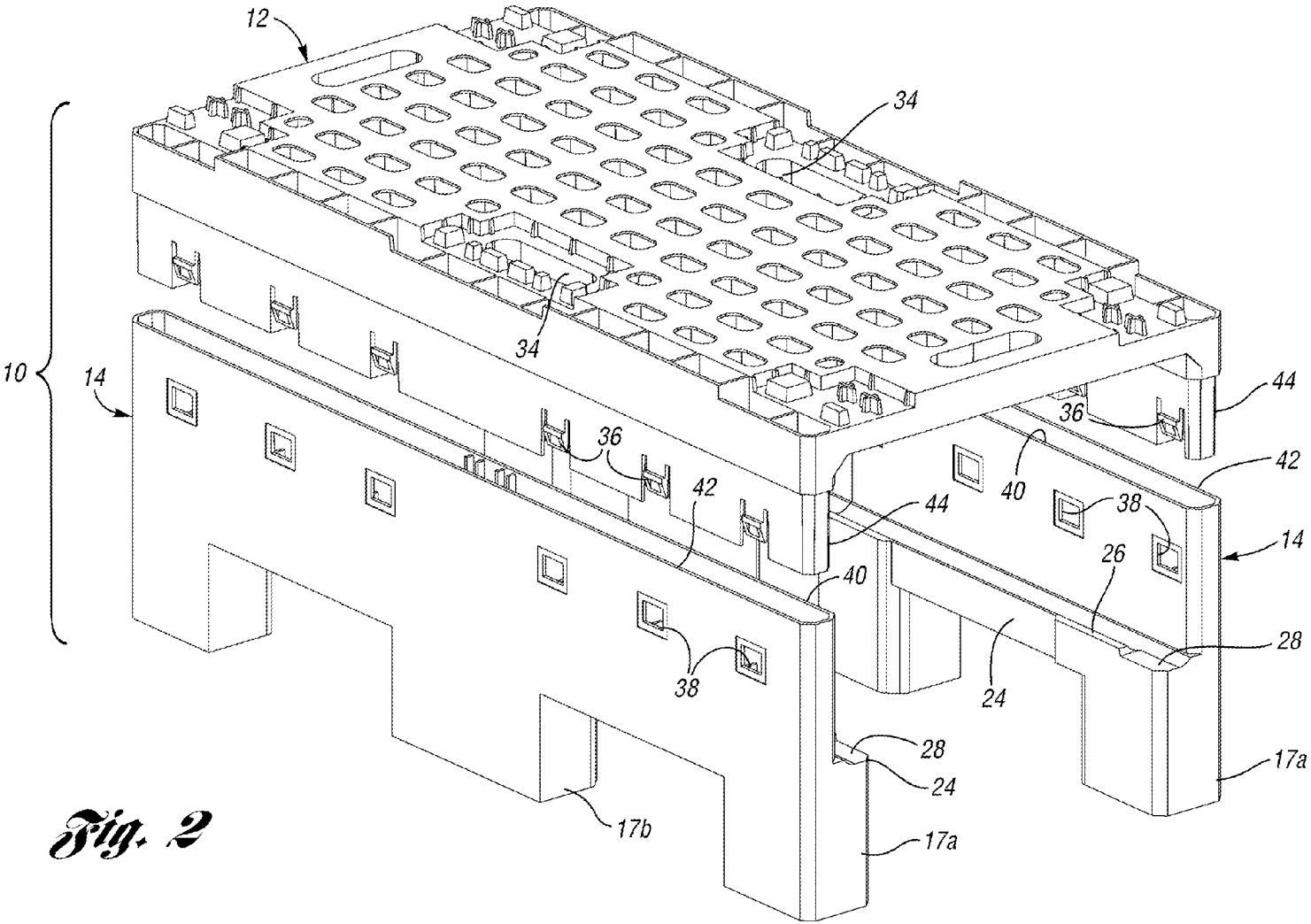
FIG. 2 is an exploded perspective view of the pallet of FIG. 1.

The deck 12 is connected to each of the supports 14 by snap-tabs 36 received in apertures 38 in interior walls 40 and exterior walls 42 of the side walls 16, as shown more clearly in FIG. 2. FIG. 2 is an exploded perspective view of the pallet 10. The deck 12 includes a pair of upper side portions 44 extending downward. The upper side portions 44 are received between the interior walls 40 and exterior walls 42 of the supports 14 and retained by the snap-tabs 36.

Figure 3:
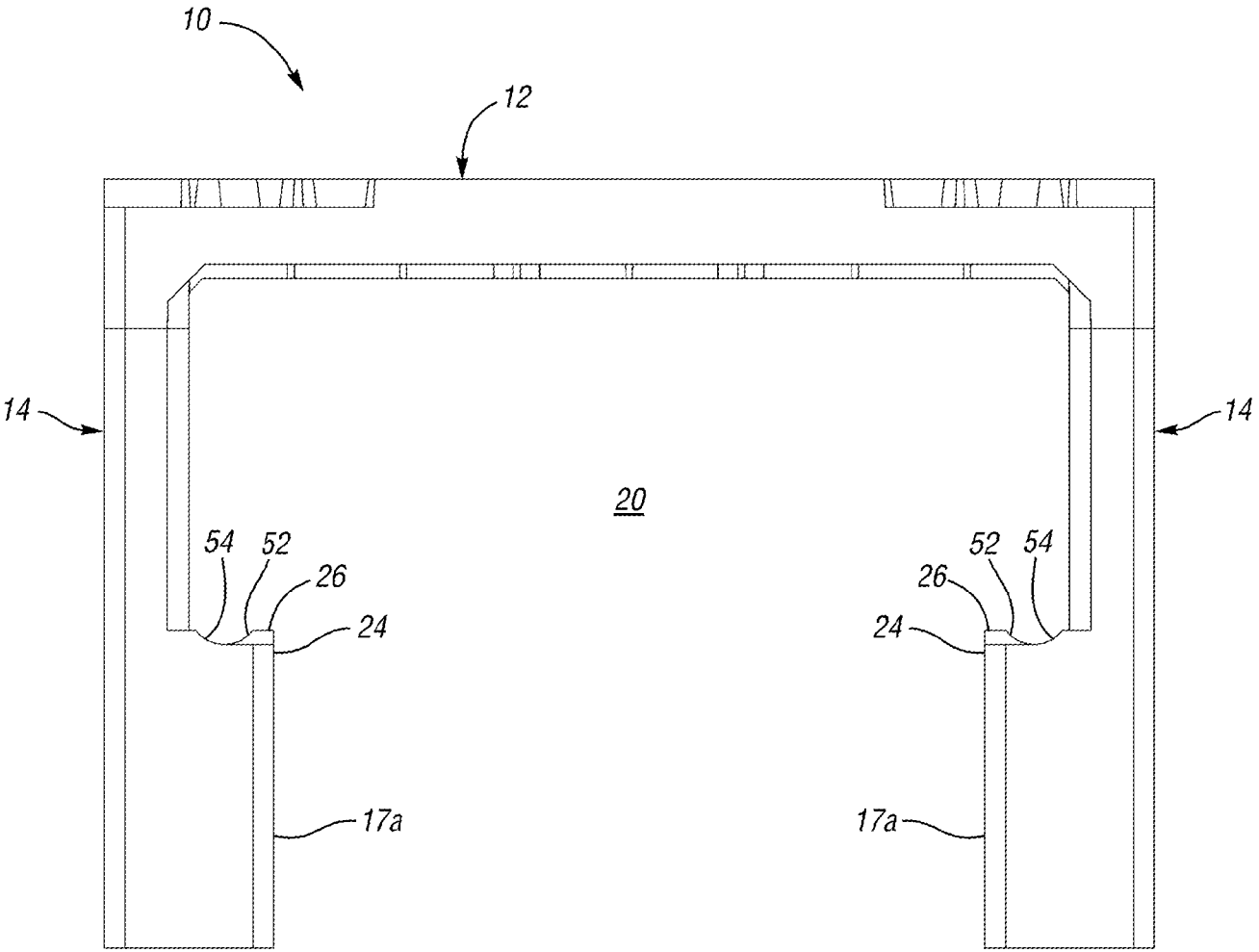
FIG. 3 is an end view of the pallet of FIG. 1.

FIG. 3 is an end view of the pallet 10. As shown, the vertical projection 26 is spaced inwardly from the foot 17 to define a frame receiving recess 52 among the lateral projection 24, the vertical projection 26 and the foot 17. The frame receiving recess 52 includes an abutment surface 54 on the upper surface of the lateral projection 24.

Figure 4:
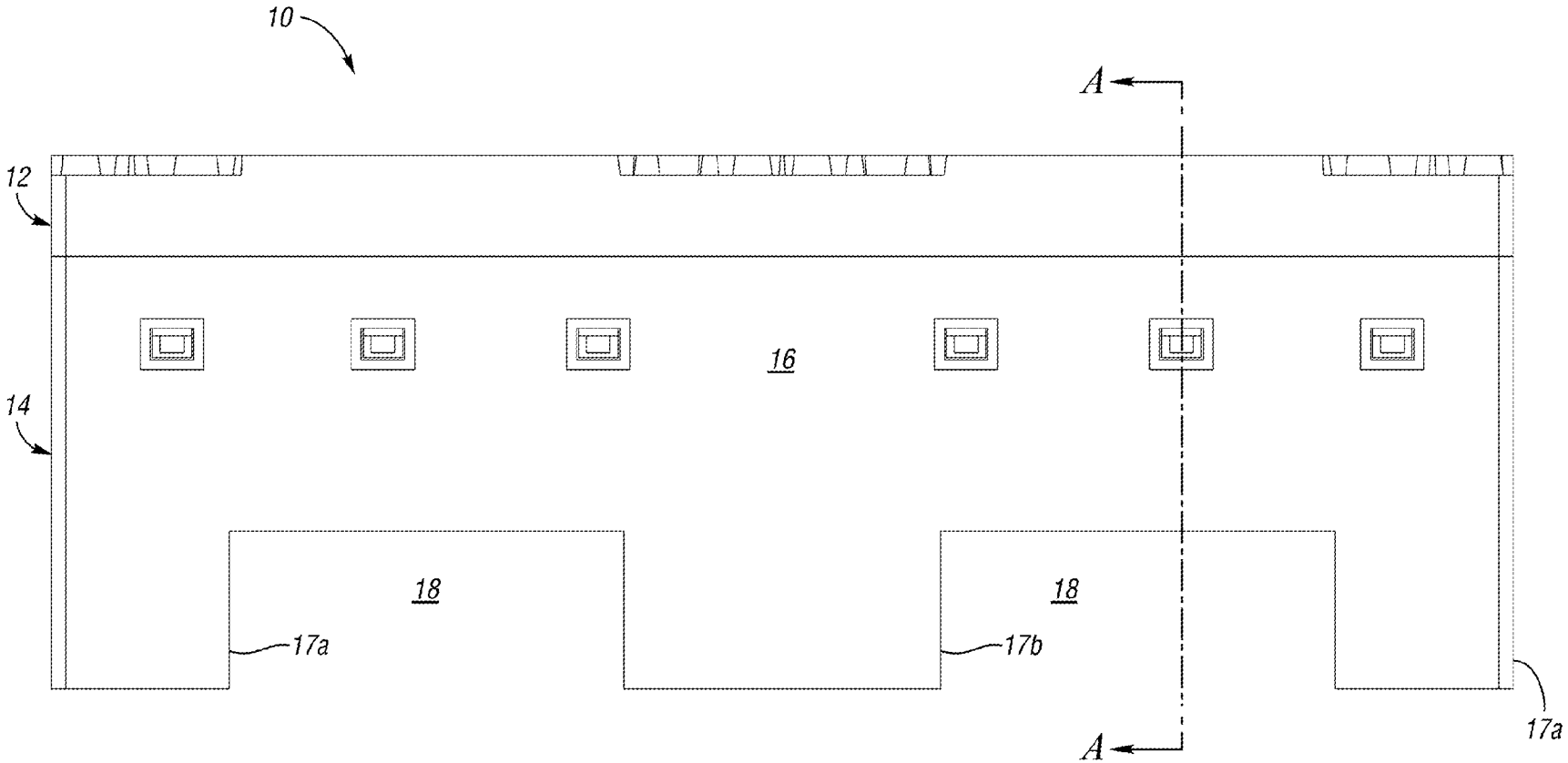
FIG. 4 is a side view of the pallet of FIG. 1.

FIG. 4 is a side view of the pallet 10. Fork receiving openings 18 are defined between each corner foot 17*a* and the side foot 17*b* and the side wall 16. The fork-receiving openings 18 provide the ability to move the pallet 10 with a forklift in a generally known manner.

Figure 5:
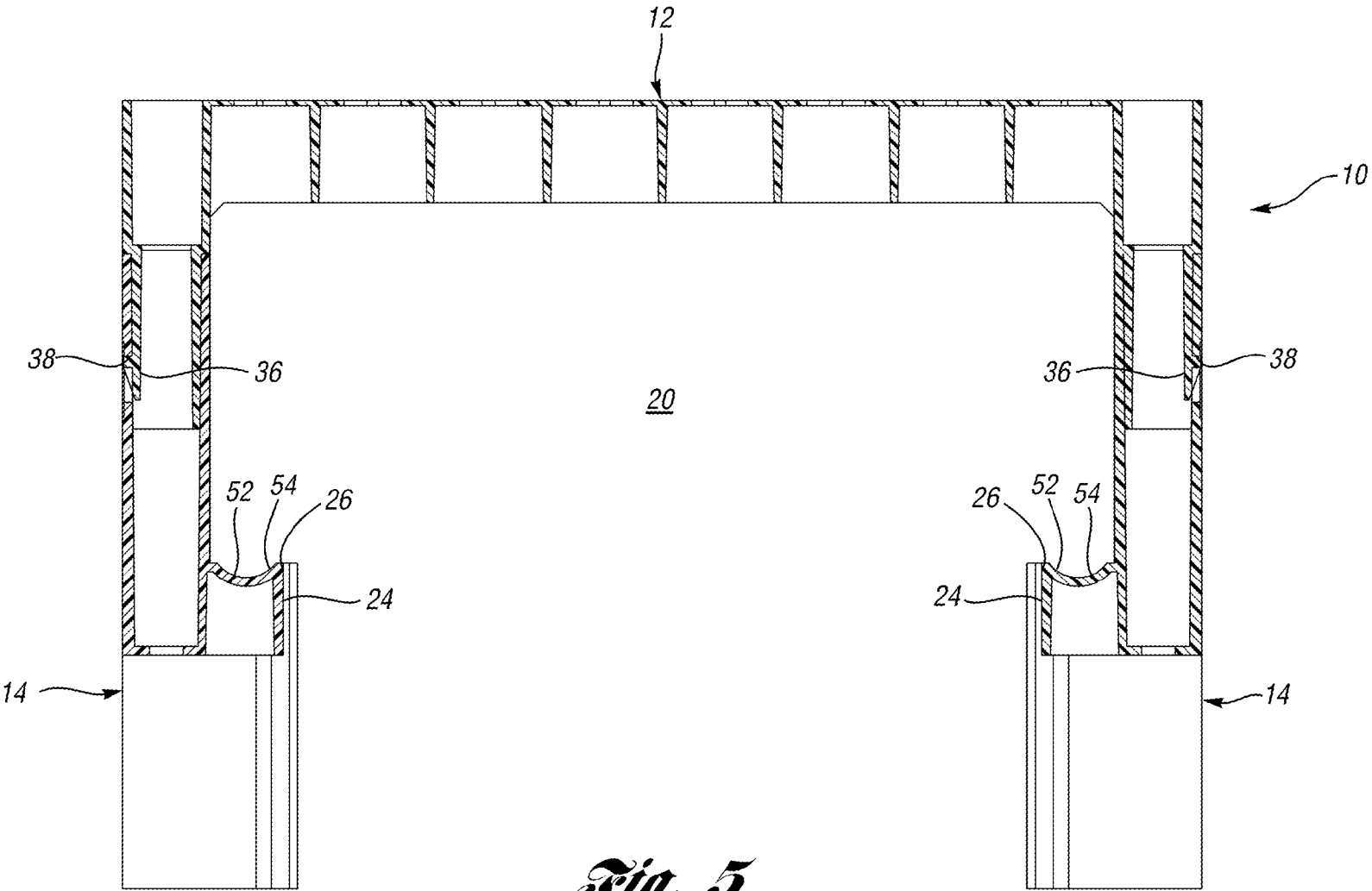
FIG. 5 is a sectional view taken along line 5-5 of FIG. 4.

FIG. 5 is a sectional view taken along line 5-5 of FIG. 4. As shown, in the embodiment shown, the lateral projections 24 and vertical projections 26 also extend between the feet 17. Again, the lateral projections 24 and vertical projections 26 could extend just along the feet 17 or just between the feet 17.

Figure 6:
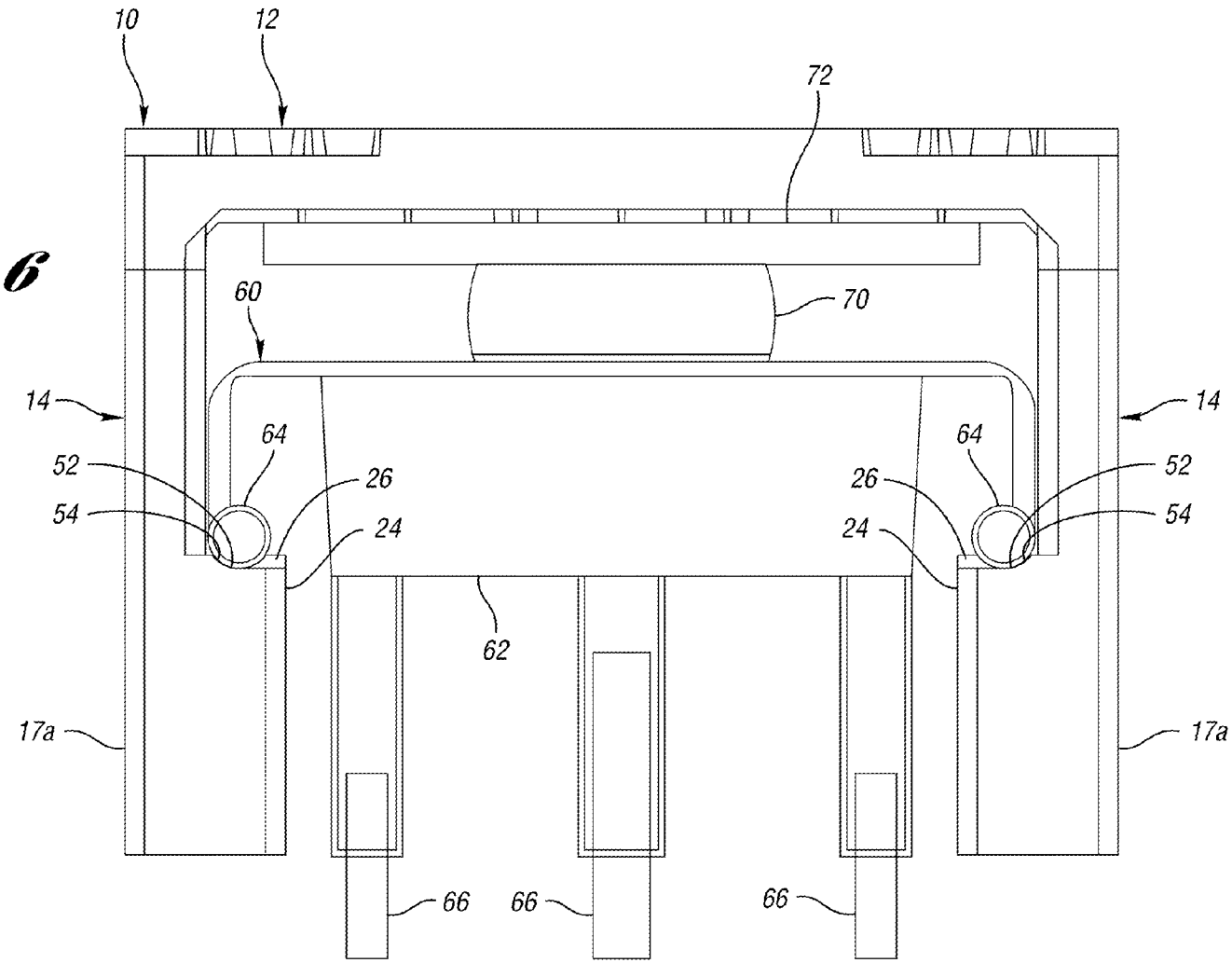
FIG. 6 is an end view of the pallet supported in a locked position on a pallet lift jack.

FIG. 6 is an end view of the pallet 10 supported in a locked position on a pallet lift jack 60. The pallet lift jack 60 includes a base 62 having a lower frame 64. The base 62 is supported on wheels 66 and includes a lift mechanism 70 for selectively raising and lowering a platform 72. The lift mechanism 70 may be pneumatic or electric or it may otherwise provide mechanical leverage for manually lifting the platform 72 and the pallet 10 when loaded (although illustrated empty). To lift the pallet 10, the pallet lift jack 60 is wheeled into the pallet lift jack opening 20 of the pallet 10 until the platform 72 is aligned beneath the deck 12. The lift mechanism 70 is then activated to bring the platform 72 into contact with the deck 12 and then raise the pallet 10 off the floor. As the deck 12 is raised, the lower frame 64 is received into the frame receiving recesses 52 of the pallet 10 (the "frame" 64 and the "platform" 72 can be any structure between which is mounted the lift mechanism 70). When the lateral projections 24 of the pallet 10 contact the lower frame 64, the pallet 10 is locked in place on the pallet lift jack 60 for transport. The lower frame 64 is disposed between the vertical projection 26 and the support 14. The vertical projection 26 prevents the support 14 from deflecting outwardly and releasing the lower frame 64. When the pallet 10 is wheeled to the desired location, the lift mechanism 70 lowers the pallet 10 to the floor and the pallet lift jack 60 is removed from the pallet lift jack opening 20.

Figure 7:
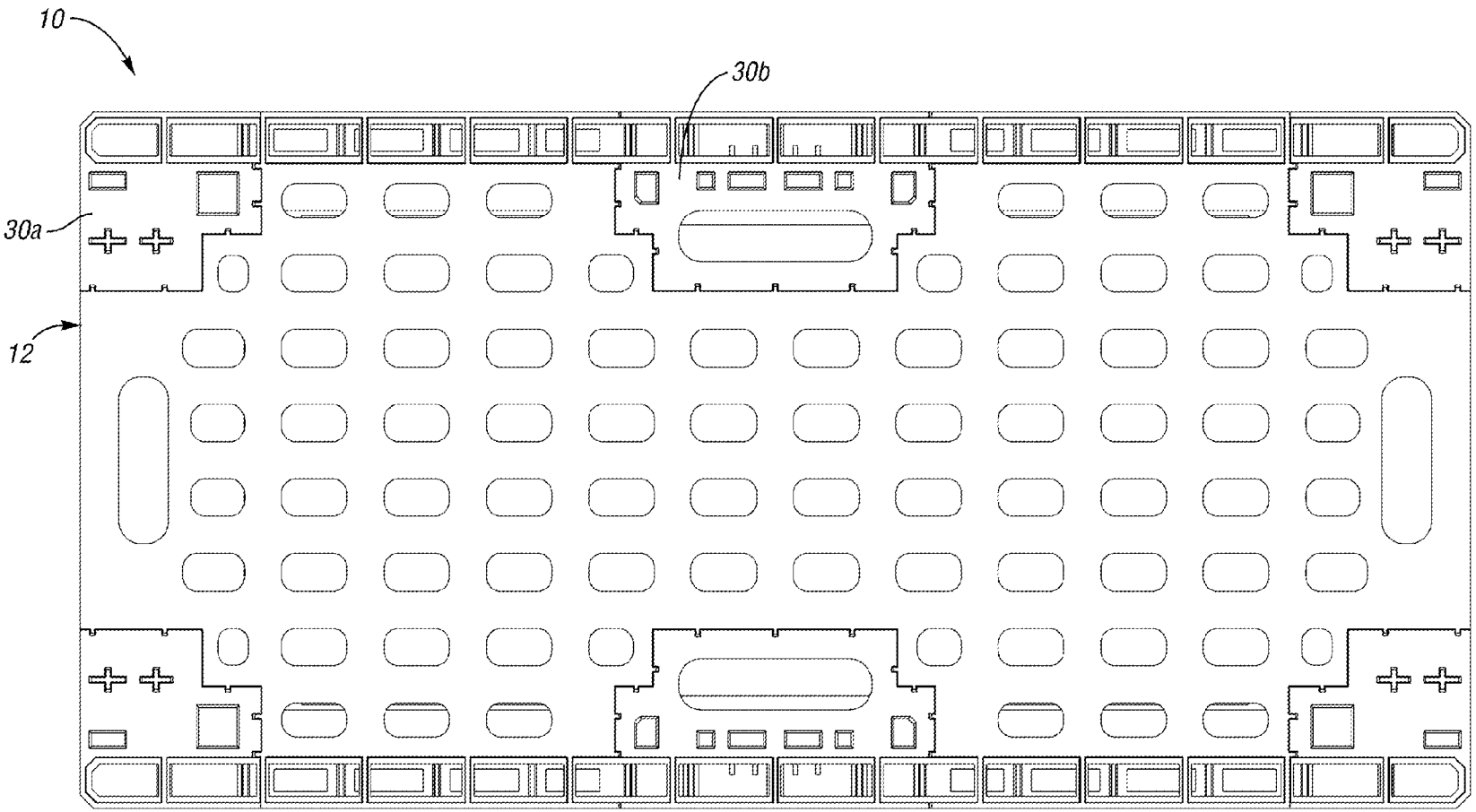
FIG. 7 is a top view of the pallet of FIG. 1.
Figure 8:
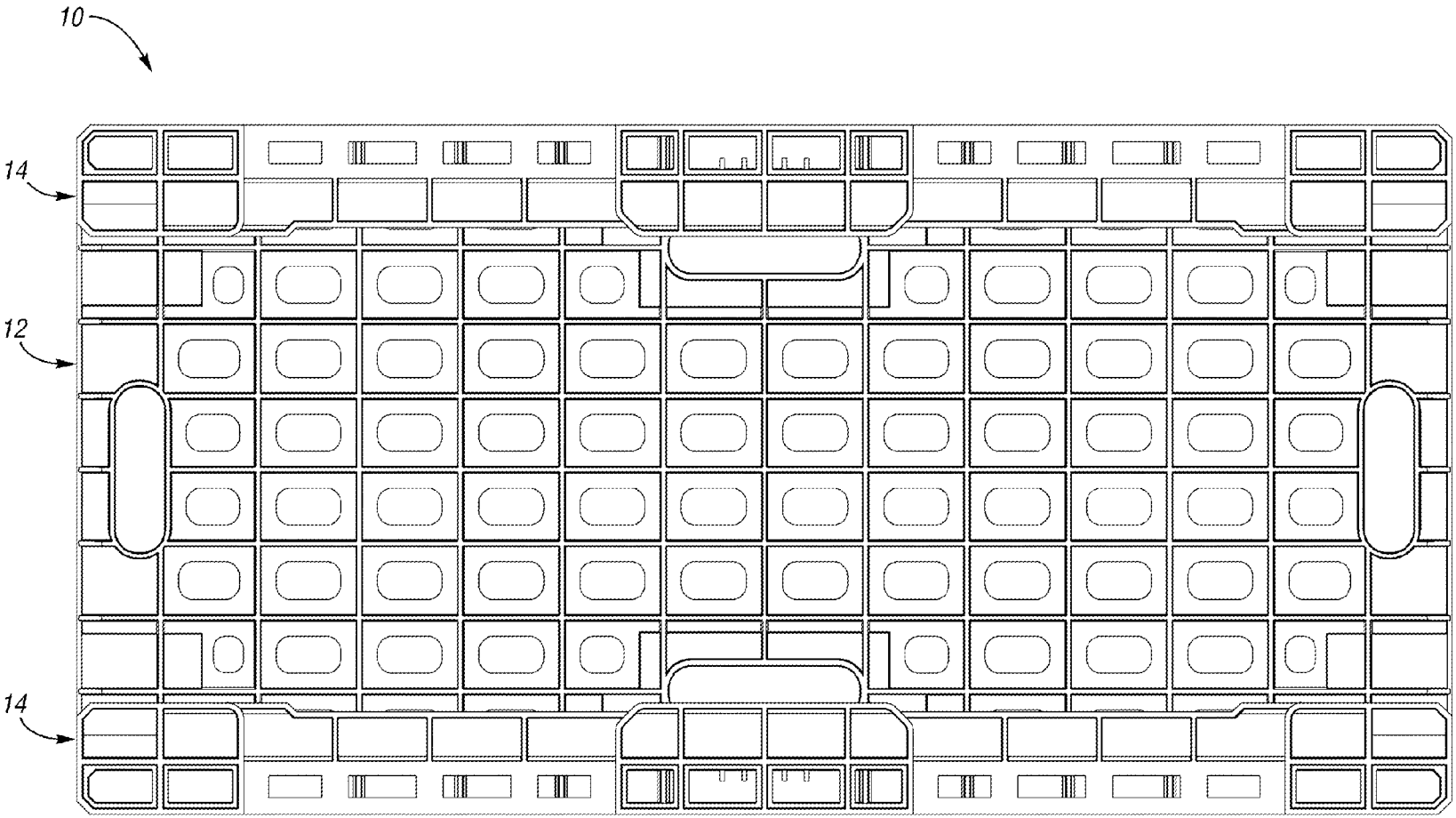
FIG. 8 is a bottom view of the pallet of FIG. 1.

FIG. 7 is a top view of the pallet 10. FIG. 8 is a bottom view of the pallet 10. The pallet 10 shown is injection molded of a plastic, such as polypropylene or HDPE, but other suitable materials and manufacturing methods could be used.

Figure 9:
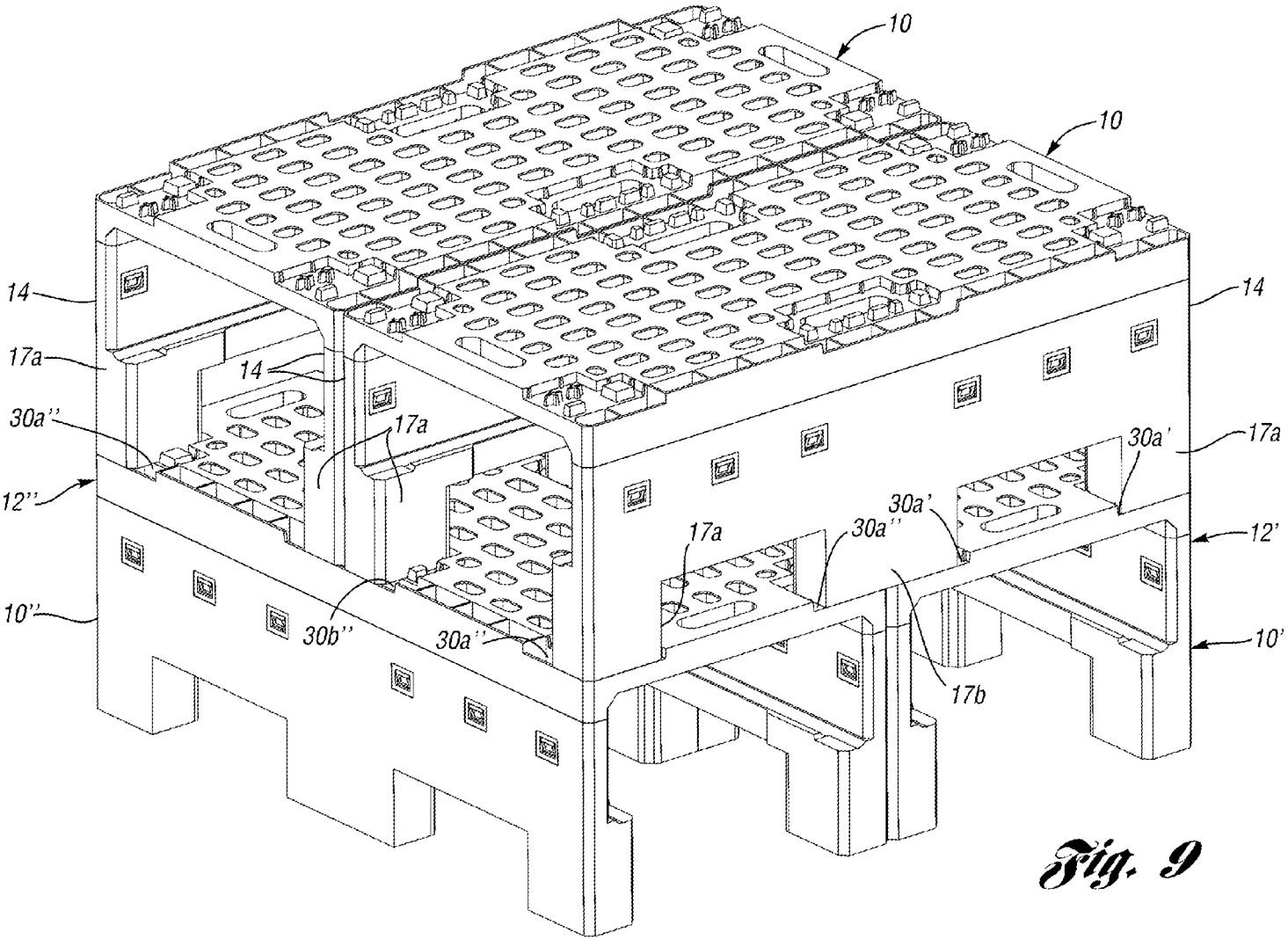
FIG. 9 is a perspective view showing a plurality of the pallets of FIG. 1 in a cross-stacked arrangement.

FIG. 9 is a perspective view of two of the pallets 10 cross-stacked on two similar pallets 10', 10". In the cross-stacked position, each pallet 10 is supported equally by the two similar pallets 10', 10". As shown, the interlocking features 30*a, b'* and 30*a, b"* are configured such that they interlock with the corner feet 17*a* and side feet 17*b* in the cross-stacked orientation. Two of the corner feet 17*a* are received in corner interlocking features 30*a"*, 30*a'*, but rotated 90 degrees relative to the lower pallets 10', 10". The other two corner feet 17*a* are received in side interlocking features 30*b"*, 30*b'*. One of the side feet 17*b* is receive in two adjacent corner interlocking features 30*a"*, 30*a'*. The other side foot 17*b* is received in two adjacent side interlocking features 30*b"*, 30*b'* (not visible in FIG. 9). The interlocking between the feet 17*a, b* and the decks 12", 12' in a cross-stacked orientation increases the stability of the empty pallets 10, 10', 10" when transported or stored.

Figure 10:
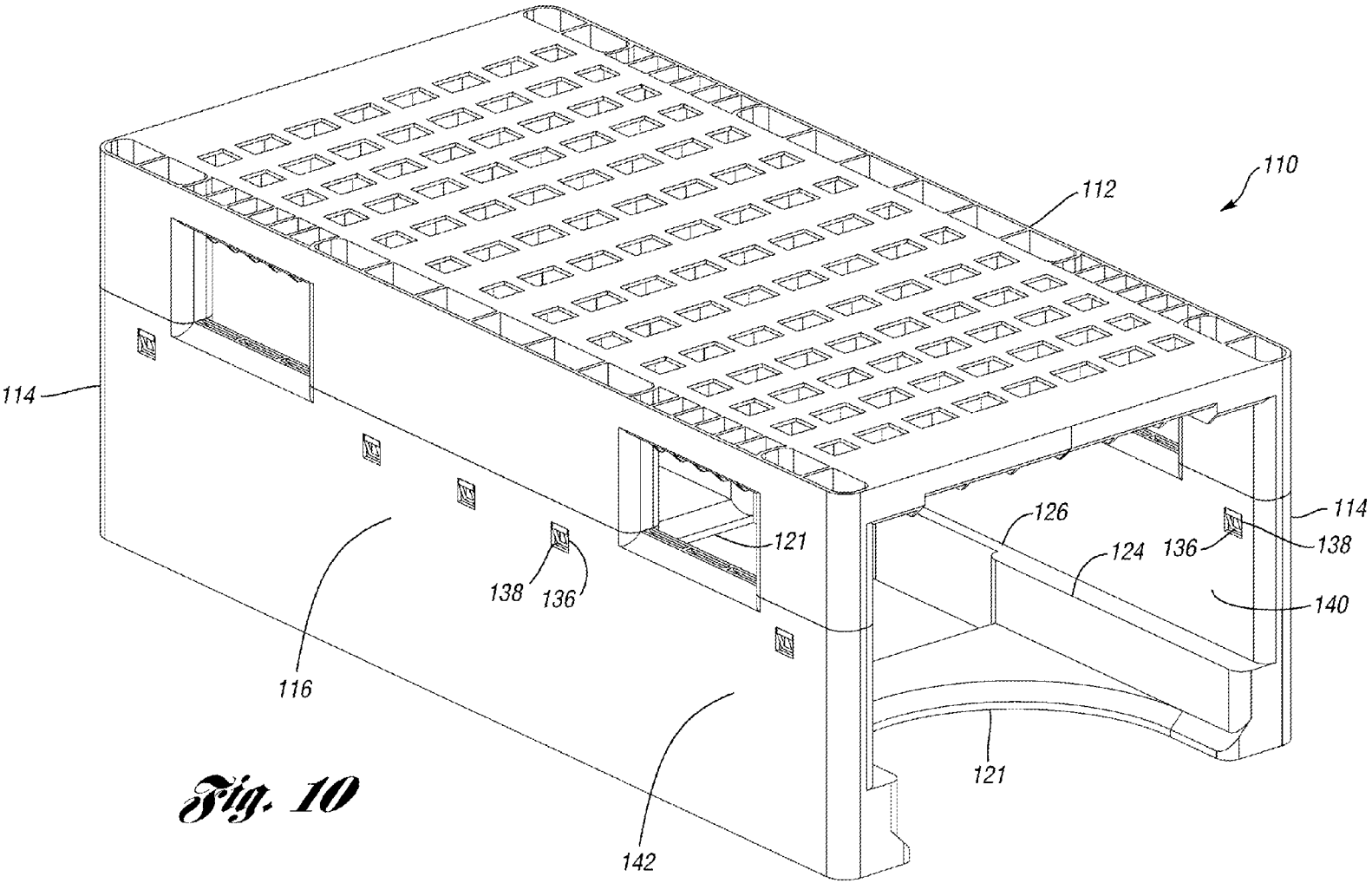
FIG. 10 is a perspective view of a pallet according to a second embodiment of the present invention.
Figure 11:
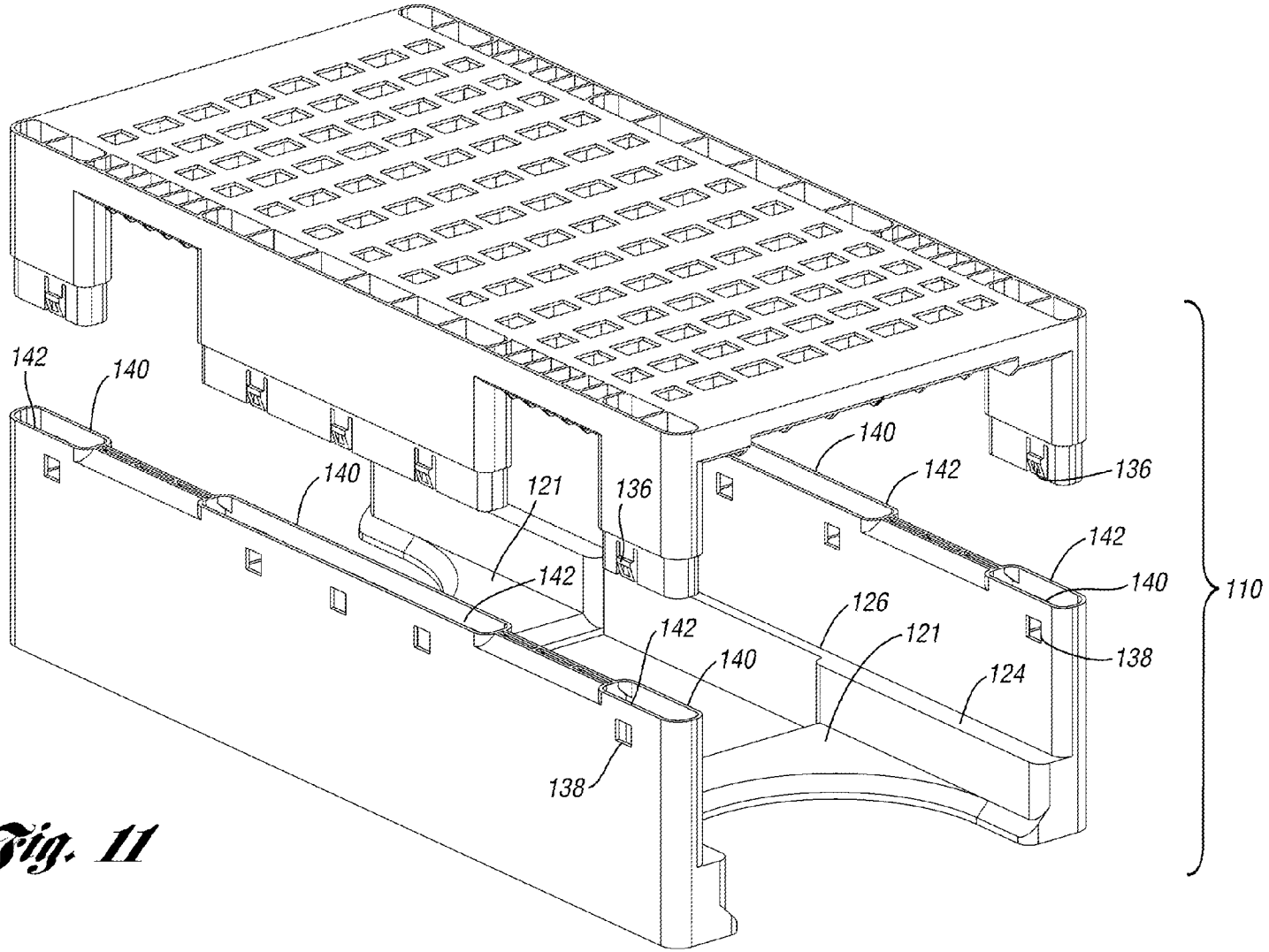
FIG. 11 is an exploded perspective view of the pallet of FIG. 10.

FIGS. 10 and 11 illustrate a pallet 110 according to a second embodiment of the present invention. The pallet 110 is generally the same as the pallet 10 described with respect to FIGS. 1-9 except as otherwise described below or shown in the figures. The pallet 110 includes a deck 112. The deck 112 is shown without the interlocking features 30 of pallet 10 (FIG. 1), but could include some features for interlocking with similar pallets 110 stacked and cross-stacked thereon. The supports 114 are connected to one another at their lower ends by runners 121. The supports 114 may be integrally molded with the runners 121 and with one another as shown, or formed separately and connected via welding, snap-fit connections, adhesive, etc.

The deck 112 is connected to each of the supports 114 by snap-tabs 136 received in apertures 138 in interior walls 140 and exterior walls 142 of the side walls 116 as shown more clearly in FIG. 10. The deck 112 includes a pair of upper side portions 144 extending downward. The upper side portions 144 are received between the interior walls 140 and exterior walls 142 of the supports 114 and retained by the snap-tabs 136. The supports 114 are shown without fork lift openings (and therefore without feet separate from the side walls 116), but could alternatively be provided with the fork lift openings and feet.

Each of the side walls 114 includes an elongated lateral projection 124 extending inwardly (i.e. toward the opposite side wall 114). Although not required, the lateral projection 124 in the embodiment shown extends the entire length of the side wall 114. A vertical projection 126 protrudes upwardly from an inner end of the lateral projection 124. The vertical projection 126 may also extend the entire length of the side wall 114, but in the embodiment shown each vertical projection 126 extends along only approximately the middle third of the side wall 114. Variations may be needed to accommodate different pallet lift jack designs. The two-piece pallet 110 is used with the pallet lift jack 60 in the same way as the pallet 10 of FIGS. 1-9.

Figure 12:
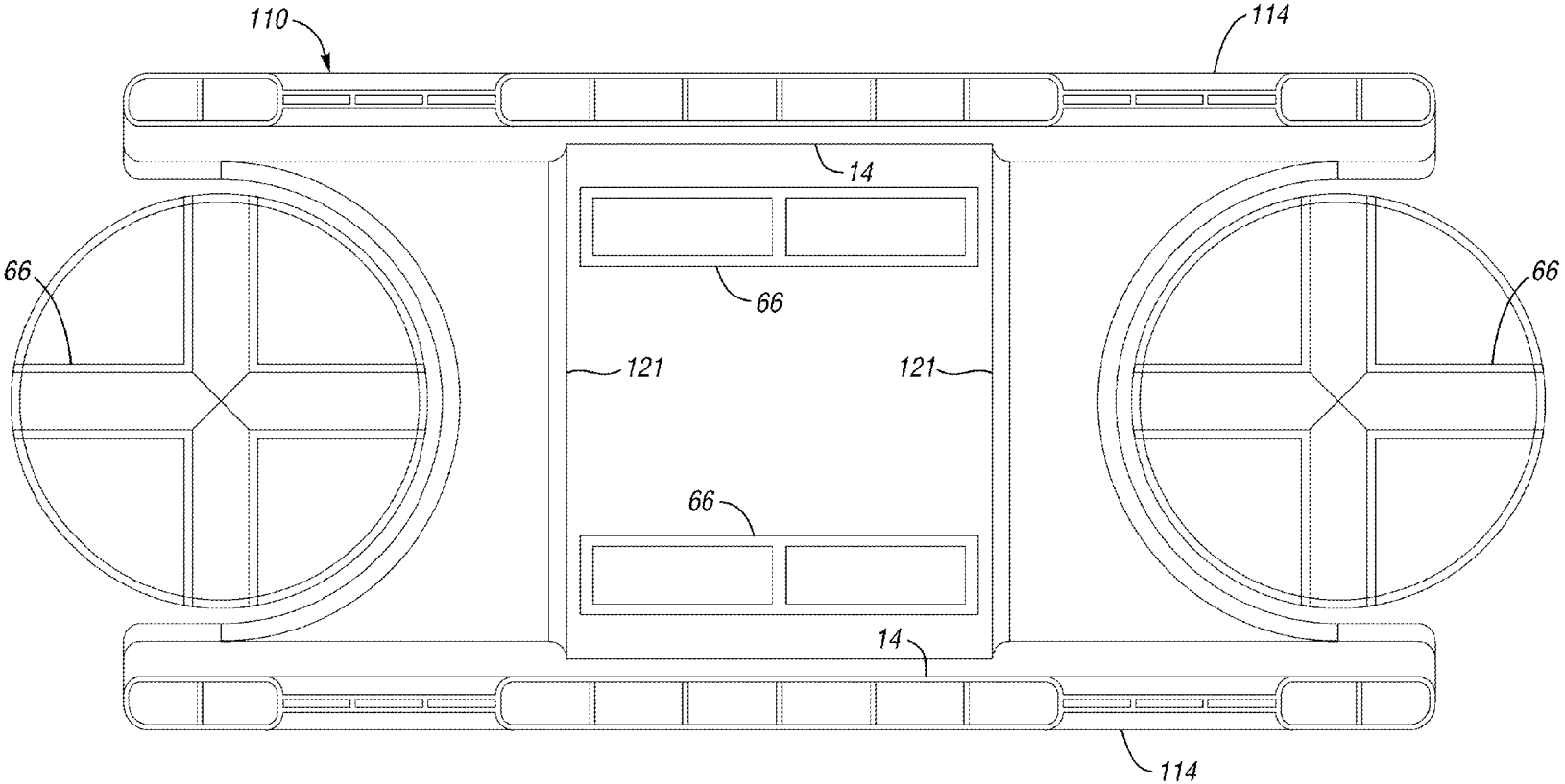
FIG. 12 is a bottom view of the pallet of FIG. 10, showing the alignment with the pallet lift jack wheels.

FIG. 12 is a bottom view of the pallet of FIG. 10, showing the alignment of the runners 121 with the pallet lift jack 60 wheels. As shown, the runners 121 are size and arranged to fit between the wheels 66 of the pallet lift jack 60 (and for the outer wheels 66, their rotation circle), so that the pallet lift jack 60 can lift the pallet 110 without the wheels 66 or supports 14 hitting the runners 121.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A pallet including:

a deck; and a first support and a second support extending downwardly from the deck, the first support including a first lateral projection projecting from the first support toward the second support, the first lateral projection having an upper abutment surface and a vertical projection protruding upwardly from the upper abutment surface and spaced inwardly from the first support, the first support snap-fit to the deck.

2. The pallet of claim 1 wherein the second support includes a second lateral projection extending toward the first support.

3. The pallet of claim 2 wherein the first support and the second support define a pallet lift jack opening therebetween.

4. The pallet of claim 1 further including an upper side portion extending downwardly from the deck, the upper side portion being snap-fit into the first support.

5. The pallet of claim 1 wherein the upper abutment surface is a recessed surface.

6. A pallet supported on a pallet lift jack, the pallet including a deck, a first support and a second support extending downwardly from the deck, the first support including a first lateral projection having an upper abutment surface and a vertical projection protruding upwardly from the upper abutment surface and spaced inwardly from the first support, the first support snap-fit to the deck; and the pallet lift jack engaging an underside of the deck and causing the upper abutment surface of the pallet to bear against a portion of the pallet lift jack, the portion of the pallet lift jack disposed at least partially between the vertical projection and the first support.

7. The pallet of claim 1 further including a runner connecting a lower end of the first support to a lower end of the second support.

8. The pallet of claim 7 wherein the runner is integrally molded with the first support and the second support.

9. The pallet of claim 7 stacked on a pallet lift jack engaging an underside of the deck and causing the upper abutment surface of the pallet to bear against a portion of the pallet lift jack, the portion of the pallet lift jack disposed at least partially between the vertical projection and the first support.

10. The pallet and pallet lift jack of claim 9 wherein the pallet lift jack includes a plurality of wheels, the runner aligned between the plurality of wheels.

11. A pallet including:

a deck having a generally planar upper support surface;

a first support and a second support extending downwardly from the deck, the first support and the second support each including a lateral projection extending inwardly, the lateral projections each having an upper abutment surface, the upper abutment surfaces disposed in a plane; and a runner connecting lower ends of the first support and the second support, the runner disposed below the plane containing the upper abutment surfaces, the runner including openings for receiving wheels of a pallet lift jack, the openings aligned below the deck;

wherein the pallet is supported on a pallet lift jack, the upper abutment surfaces of the pallet bearing against portions of the pallet lift jack.

12. The pallet of claim 11 wherein the plane containing the upper abutment surfaces is generally parallel to the upper support surface of the deck.

13. A pallet including:

a deck having at least two upper side wall portions extending downwardly; and a plurality of supports, each snap-fit connected to one of the upper side wall portions, at least two of the plurality of supports each including a lateral projection extending inwardly, each of the lateral projections having an upper abutment surface, the lateral projections each including a vertical projection spaced inwardly from the associated support, thereby defining a receiving area therebetween, the at least two of the plurality of supports defining a pallet lift jack opening between their associated lateral projections.

* * * * *